US007039209B2

(12) United States Patent
Schmitt

(10) Patent No.: US 7,039,209 B2
(45) Date of Patent: May 2, 2006

(54) COVER DEVICE FOR HEARING AIDS

(75) Inventor: Christian Schmitt, Grossenseebach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 133 days.

(21) Appl. No.: 10/401,075

(22) Filed: Mar. 27, 2003

(65) Prior Publication Data

US 2003/0185413 A1 Oct. 2, 2003

(30) Foreign Application Priority Data

Mar. 27, 2002 (DE) ..... 102 13 847

(51) Int. Cl.
*H04R 25/00* (2006.01)

(52) U.S. Cl. ..... 381/322; 381/323; 381/324
(58) Field of Classification Search ..... 381/322–324, 381/314
See application file for complete search history.

(56) References Cited

U.S. PATENT DOCUMENTS

| | | | | |
|---|---|---|---|---|
| 4,570,290 | A | 2/1986 | Anderson | |
| 4,831,655 | A * | 5/1989 | Buettner | 381/322 |
| 4,870,688 | A * | 9/1989 | Voroba et al. | 381/60 |
| 5,008,943 | A | 4/1991 | Arndt et al. | |
| 5,347,584 | A * | 9/1994 | Narisawa | 381/323 |
| 5,784,470 | A | 7/1998 | Fackler et al. | |
| 6,354,990 | B1 * | 3/2002 | Juneau et al. | 600/25 |
| 6,430,296 | B1 * | 8/2002 | Olsen | 381/322 |

FOREIGN PATENT DOCUMENTS

| | | |
|---|---|---|
| WO | 86/06919 | 11/1986 |
| WO | 98/47319 | 10/1998 |

* cited by examiner

*Primary Examiner*—Huyen Le
*Assistant Examiner*—Phylesha L Dabney
(74) *Attorney, Agent, or Firm*—Schiff Hardin LLP

(57) ABSTRACT

For reducing the space requirement for locking systems, a battery compartment and an electronics module are locked by means of a single articulation. For removing the battery, the battery compartment is swiveled open; for unlocking the electronics module, the battery compartment is removed from the plate by pulling the wire spring from the receptacles. The articulation thus has a double function.

8 Claims, 2 Drawing Sheets

COVER DEVICE FOR HEARING AIDS

BACKGROUND OF THE INVENTION

1. Field of the Invention

The present invention is directed to a device for covering a hearing aid housing with a housing cover that comprises an opening for introducing a battery and an electronics module and with a battery compartment that is pivotably attached to the housing cover using a connector element for the acceptance of a battery. In particular, the present invention is directed to the locking system of the battery compartment.

2. Description of the Related Art

In-the-ear hearing aids (ITE) have a housing that is individually matched to the auditory canal of the hearing aid user. A housing cover is applied onto the housing at the side facing away from the tympanum. This housing cover is usually mounted in a fixed manner on the housing. For loading the hearing aid with a battery, the hearing aid cover comprises a specific battery compartment that is pivotably attached to the housing cover. Such a battery compartment is disclosed by U.S. Pat. No. 5,784,470. When removing the battery from the hearing aid, the battery compartment is swiveled open from the housing cover, so that the battery is conducted to the outside for removal.

Various embodiments of battery compartments, however, are also known in behind-the-ear hearing aids (BTE). For example, U.S. Pat. No. 4,831,655 discloses a cover for a battery compartment that is pivotably seated in the housing of the BTE device using a wire spring. The wire spring serves for simple assembly and to assure a certain ruggedness of the articulation of the battery cover.

An ITE device usually comprises integrated electronics that is equipped with an amplifier, a microphone and further components. Over and above this, ITE devices are available that have modular electronics assemblies. For example, U.S. Pat. No. 5,008,943 discloses such a module. For removing the module, however, this patent discloses the entire housing cover being swiveled open.

Module inserts are also known that are locked to the housing cover with springs or with snap-in noses that are additionally injection-applied to the module.

SUMMARY OF THE INVENTION

The object of the present invention is to reduce the space requirement of a removal and introduction device for a battery and an electronics module of an ITE hearing aid.

This object is inventively achieved by a device for covering a hearing aid housing with a housing cover that comprises an opening for introducing a battery and an electronics module and with a battery compartment that is pivotably attached to the housing cover using a connector element for accepting a battery, where the battery compartment covers the opening such that, in every pivoted condition, the electronics module cannot be conducted through the opening, and the connector element with the battery compartment is removable from the housing cover so that the electronics can be conducted through the opening when the battery compartment is removed.

DESCRIPTION OF THE DRAWINGS

The present invention is explained below in greater detail on the basis of the attached drawings.

DETAILED DESCRIPTION OF THE PREFERRED EMBODIMENTS

The embodiments described below are preferred exemplary embodiments of the present invention.

In advantageous embodiments of the invention, the connector element may comprise a wire spring having two end sections and an elastic middle section so that the two end sections, which lie on an axis in the loaded condition, are displaceable along this axis. For example, the middle section of the wire spring may be a circular arc-shaped, U-shaped, acute angled wire section or the like.

The end sections of the wire spring may advantageously project through guides of the battery compartment and—at the outermost end—through guides or receptacles of the housing cover. For removing the battery compartment, the outermost ends of the end sections of the wire spring may be pulled from the guides of the housing cover. The wire spring can remain in the guides of the battery compartment, even when the battery compartment is removed from the housing cover.

So that the electronics module has a defined position in the installed condition, the opening through which the electronics module is inserted into the hearing aid should may comprise at least one guide channel. This then also has the advantage that, for example, the module must be perpendicularly moved out of the opening, i.e. with a defined motion. As a result, a comparatively small edge at the battery compartment can prevent the electronics module from slipping out of the hearing aid.

The battery compartment advantageously represents a holder for the battery and for a cover for the opening. In the closed condition, the battery compartment should completely close the opening for protecting the electronics lying below. Given a beneficial shape, a sound admission opening for a microphone in the electronics module lying below may be provided in the pivotable battery compartment in addition to the mount of the battery.

Figure 1:
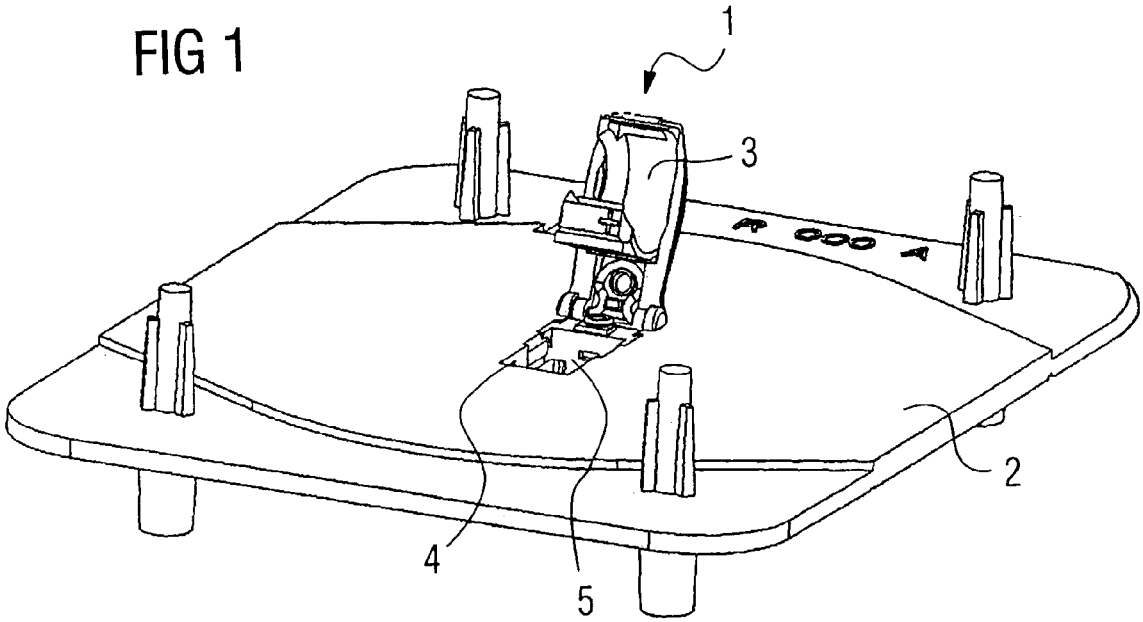
FIG. 1 is a pictorial perspective view of a swiveled-open battery compartment according to the present invention.

FIG. 1 shows an embodiment having a battery compartment 1 in its hinged open condition. In the illustrated case, it is mounted at a plastic lamina 2 that, like the housing cover of a hearing aid, represents a plastic injection molded part. The battery compartment 1 comprises a battery holder 3 in which the battery of a hearing aid is held. In the closed condition, the battery holder including battery is swiveled into an opening 4. An electronics module 5 is inserted into the opening. When the battery compartment 1 is swiveled down, then it covers the entire opening 4 including the electronics module 5.

Figure 2:
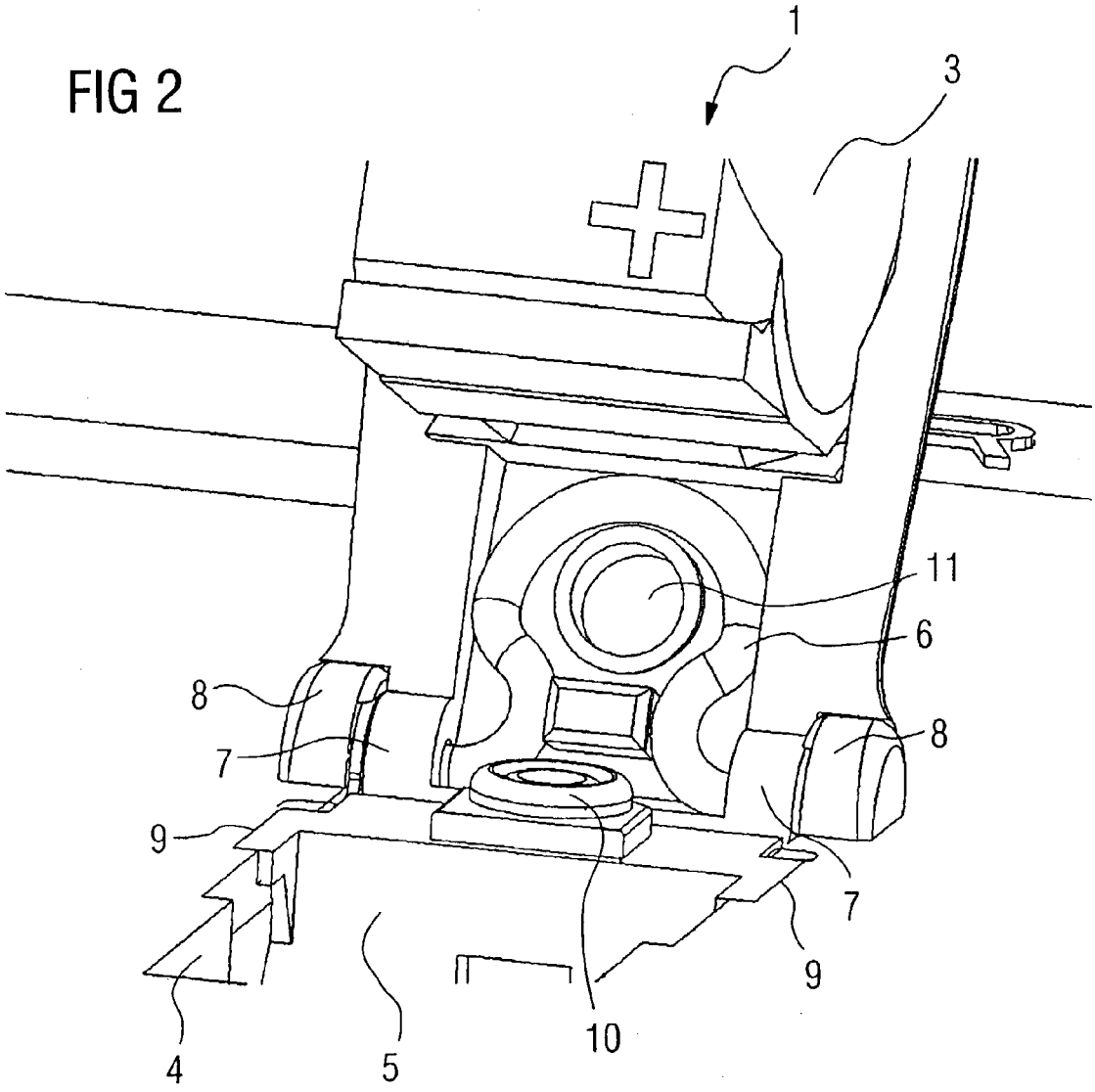
FIG. 2 is a pictorial a perspective view of the detail of the closure mechanism of the battery compartment shown in FIG. 1.

FIG. 2 shows the articulation mechanism of the battery compartment 1 in detail. The articulation around which the battery compartment 1 is pivotably seated is composed of a wire spring 6, guides 7 that are attached to the battery compartment 1 and receptacles 8 that are attached to the plate 2.

The wire spring 6 has an essentially Ω-shape, where its ends correspond to the articulation axis. The two ends or end sections are guided into the respective receptacles 8 by the two guides 7. This creates a hinge for the battery compartment 1 whose elastic hinge pin is established by the wire spring 6.

The electronics module 5 is plugged into the plate 2 by guides 9 and is thus fixed in this position. It is thus not possible for the electronics module 5 to slide toward the front, with reference to the illustration of FIG. 2. Since the electronics module 5 comprises a continuation (not shown) at what is its backside with reference to the illustration of FIG. 2 (this continuation extending under the articulation with the wire spring 6 and the guides 7) the electronics module 5 cannot be removed from the opening 4 when the battery compartment 1 together with the articulation is secured on the plate 2.

What is important for this function is not the continuation (not shown) at the electronics module 5 but the fact that the battery compartment 1 makes the opening 4 smaller—even in the swiveled-open condition—such that the electronics module 5 cannot be pushed through the opening 4. This permits the electronics module 5 to be fixed without a specific mount in the opening 4. For removing the electronics module 5, the wire spring 6 is grasped, for example, with a tweezers, at the narrowest point of the Ω-shape and is pressed together. As a result, the outermost ends of the wire spring are pulled from the receptacles 8, permitting the battery compartment to be removed from the plate 2. The electronics module can then also be removed from the opening 4.

The articulation composed of the wire spring 6, the guides 7 and the receptacles 8 thus has the double function of pivoting the battery compartment 1 and of locking the electronics module 6 in the opening 4. Consequently, a specific locking unit for the electronics module 5 can be eliminated, this reducing the space requirement on the housing cover 2. As already described, the unlocking of the electronics module 5 ensues removing the battery compartment 1, which is possible without further effort as a result of the specifically designed wire spring.

The electronics module 5 comprises a microphone whose exit/passageway opening 10 is shown in FIG. 2. So that this opening 10 is not covered by the battery compartment 1 in the closed condition of the latter, the battery compartment comprises a through opening 11 at an appropriate location. Since this opening 11 is arranged in the proximity of the articulation 6, 7, 8, the Ω-shape of the wire spring 6 also proves beneficial because the wire is conducted around the opening 11 given this wire shape.

It is also very advantageous when the wire spring 6 is dimensioned such that the ends of the wire spring are pulled only from the receptacles 8 but not from the guides 7 when the wire spring is compressed. The wire spring 6 can thus not be lost given removal of the battery compartment, and the mounting of the battery compartment 1 can be accomplished with a few manipulations.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The particular implementations shown and described herein are illustrative examples of the invention and are not intended to otherwise limit the scope of the invention in any way. For the sake of brevity, conventional systems, and other functional aspects of the systems (and components of the individual operating components of the systems) may not be described in detail. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A device for covering a hearing aid housing, comprising:

a housing cover that comprises an opening for introducing a battery;

an electronics module which is equipped with an amplifier and a microphone; and a battery compartment that is pivotably attached directly to the housing cover with a connector element, the battery compartment being configured to accept a battery and being configured to cover the opening such that in every pivoted condition, the electronics module cannot be moved through the opening, the pivoting element with the battery compartment being removable from the housing cover so that the electronics module can be moved through the opening when the battery compartment is removed from the housing cover.

2. The device according to claim 1, wherein the pivoting element comprises a wire spring having two end sections and an elastic middle section lying between the two end sections.

3. The device according to claim 2, wherein the end sections of the wire spring lie on an axis in a loaded condition, and the middle section comprises a shape selected from the group consisting of circular arc-shaped, U-shaped or triangular-shaped.

4. The device according to claim 2, wherein the battery compartment comprises guides through which the end sections of the wire spring project into receptacles of the housing cover.

5. The device according to claim 4, wherein the middle section of the wire spring is configured to be bent such that the end sections of the wire spring can be pulled completely from the receptacles of the housing cover in order to remove the battery compartment from the housing cover.

6. The device according to claim 1, wherein the opening in the housing cover comprises at least one guide channel for guiding the electronics module when it is conducted through the opening.

7. The device according to claim 1, wherein the battery compartment is configured to be pivoted into a closed condition in which it completely covers the opening.

8. The device according to claim 1, wherein the battery compartment comprises a sound opening for a microphone integrated in the electronics module.

* * * * *